US005616229A

United States Patent [19]

Samsonov et al.

[11] Patent Number: 5,616,229

[45] Date of Patent: Apr. 1, 1997

[54] PROCESS FOR COATING METALS

[75] Inventors: Victor Samsonov; Misha Hiterer, both of Jerusalem, Israel

[73] Assignee: Almag AL, Jerusalem, Israel

[21] Appl. No.: 445,106

[22] Filed: May 19, 1995

[30] Foreign Application Priority Data

Jun. 1, 1994 [IL] Israel ..... 109857

[51] Int. Cl.[6] ..... C25D 5/18; C25D 11/00

[52] U.S. Cl. ..... 205/107; 205/321; 205/322; 205/323

[58] Field of Search ..... 205/106, 107, 205/321, 322, 323

[56] References Cited

U.S. PATENT DOCUMENTS

| | | | |
|---|---|---|---|
| 3,293,158 | 12/1966 | McNeill et al. | 204/56 |
| 3,812,021 | 5/1974 | Craig et al. | 204/58 |
| 3,812,022 | 5/1974 | Rogers et al. | 204/58 |
| 3,812,023 | 5/1974 | Schardein et al. | 204/58 |
| 3,832,293 | 8/1974 | Hradcovsky et al. | 204/56 R |
| 3,834,999 | 9/1974 | Hradcovsky et al. | 204/56 R |
| 3,956,080 | 5/1976 | Hradcovsky et al. | 204/56 R |
| 4,082,626 | 4/1978 | Hradcovsky | 204/56 R |
| 4,659,440 | 4/1987 | Hradcovsky | 204/58 |
| 4,668,347 | 5/1987 | Habermann et al. | 204/33 |
| 5,069,763 | 12/1991 | Hradcovsky | 205/326 |
| 5,147,515 | 9/1992 | Hanagata et al. | 204/164 |
| 5,275,713 | 1/1994 | Hradcovsky | 205/106 |

*Primary Examiner*—Kathryn L. Gorgos
*Assistant Examiner*—William T. Leader
*Attorney, Agent, or Firm*—Foley & Lardner

[57] ABSTRACT

The invention provides a process for forming a ceramic coating on a valve metal selected from the group consisting of aluminum, zirconium, titanium, hafnium and alloys of these metals. The process comprises the steps of (a) immersing the metal as an electrode in an electrolytic bath comprising water and a solution of an alkali metal hydroxide; (b) providing an opposite electrode immersed in or containing the electrolyte liquid; (c) passing a modified shaped-wave alternate electric current from a high voltage source of at least 700 V through a surface of the metal to be coated and the opposite electrode, thereby causing dielectric breakdown, heating, melting, and thermal compacting of a hydroxide film formed on the surface of the metal to form and weld a ceramic coating thereto, and (d) changing the composition of the electrolyte while the ceramic coating is being formed, the change being effected by adding an oxyacid salt of an alkali metal. In a preferred embodiment, the modified shaped-wave electric current rises from zero to its maximum height and falls to below 40% of its maximum height within less than a quarter of a full alternating cycle. Also provided is apparatus for carrying out this process.

8 Claims, 3 Drawing Sheets

PROCESS FOR COATING METALS

The present invention relates to a ceramic coating process for valve metals, to articles coated thereby, and to an apparatus for carrying out said process.

Valve metals exhibit electrolytic rectification, and the present invention is therefore concerned with providing a coating process and apparatus for coating aluminium, zirconium, titanium, hafnium, and alloys thereof.

More particularly, the present invention is concerned with an electrolytical process using a shaped-wave, high-voltage alternating current to achieve melting during coating of even a thick layer, such a thick layer being achieved in a short time by changing electrolyte composition during the course of the process.

Aluminium, titanium and their alloys have favourable strength/weight ratios which suit these metals to many applications, for example, for use in aircraft and for fast-moving parts in internal combustion engines. As these metals do not, however, exhibit particularly good wear properties, coatings are often used to improve wear and erosion-resistance. The applied coatings are likely to achieve further design requirements such as resistance to chemicals, particularly acids and alkalies; allowance of exposure to higher temperatures; reduction of friction, and the provision of dielectric properties. While the low-cost, widely-used anodizing process achieves some of these aims for moderate service, ceramic coatings are required for severe service requirements.

A number of electrolytic coating processes for these metals are known, which use direct current and/or voltages below 600 V. Such processes are described, for example, in U.S. Pat. Nos. 3,956,080; 4,082,626 and 4,659,440. These and the majority of recent disclosures describe processes which form ceramic films using an anode spark discharge technique, and which achieve good results regarding coating corrosion resistance and adhesion. Such methods do, however, have two important drawbacks: low film hardness and slow film formation.

In U.S. Pat. No. 5,147,515, Haganata et al. disclose the use in an electrolytic bath of a dispersion comprising an aqueous solution of a water-soluble or colloidal silicate and/or an oxyacid salt to which ceramic particles are dispersed. Voltage is increased during film formation from 50–200 V, and may finally exceed 1000 V. With regard to wave form, said patent states that the output from a power supply may be a direct current having any wave form, but preferably those having a pulse shape (rectangular wave form), saw-tooth wave form, or DC half-wave form. Such language does not imply recognition that a sharply-peaked wave form makes a major contribution to providing a dense, hard film.

The speed of film formation reported in the eight examples provided in said patent can be calculated as follows:

| Example No. | Film Thickness Microns | Coating Time Minutes | Formation Velocity Microns/Minute |
|---|---|---|---|
| 1 | 35 | 20 | 1.75 |
| 2 | 31 | 20 | 1.55 |
| 3 | 28 | 30 | 0.93 |
| 4 | 27 | 20 | 1.35 |
| 5 | 36 | 30 | 1.20 |
| 6 | 14 | 30 | 0.47 |
| 7 | 15 | 30 | 0.50 |
| 8 | 28 | 30 | 0.93 |

Such slow rates of film formation do not compare well with those of the present invention.

Also, no indication was given in U.S. Pat. No. 5,147,515 whether it is possible, through the method of said patent, to produce very thick coatings, e.g., in the range of 300–700 microns.

A recently-developed coating method, known as the Kepla-Coat Process, is based on plasmachemical anodic oxidation. The cathode is the surface film of an organic electrolyte, above which the part to be coated is suspended, forming the anode. A plasma is formed which causes the production of a ceramic coating on the anode and heating of the workpiece. Due to the formation of an oxide film on the anode, the process produces a film no thicker than about 10 microns and terminates in 8–10 minutes. Workpiece heating occurs, as the workpiece is not surrounded by liquid; non-symmetrical or slender workpieces are likely to suffer distortion. A further disadvantage of the Kepla-Coat Process is that the high rate of electrolyte evaporation poses an environmental problem.

It is therefore one of the objects of the present invention to obviate the disadvantages of the prior art ceramic coating processes and to provide a process which produces a hard film with strong adherence and minimum porosity.

It is a further object of the present invention to provide a method for producing coatings up to 300 and more microns thick within a moderate time span.

The present invention achieves the above objectives and others by providing a process for forming a ceramic coating on a valve metal selected from the group consisting of aluminium, zirconium, titanium, hafnium and alloys of these metals, said process comprising: immersing said metal as an electrode in an electrolytic bath comprising water and a solution of an alkali metal hydroxide; providing an opposite electrode immersed in or containing the electrolyte liquid; passing a modified shaped-wave alternate electric current from a high voltage source of at least 700 V through a surface of said metal to be coated and said opposite electrode, thereby causing dielectric breakdown, heating, melting, and thermal compacting of a hydroxide film formed on the surface of said metal to form and weld a ceramic coating to said metal, and changing the composition of said electrolyte while said ceramic coating is being formed, said change being effected by adding a salt containing a cation of an alkali metal and an oxyacidic anion of an element.

In a preferred embodiment of the present invention, there is provided such a process, wherein said shaped-wave electric current rises from zero to its maximum height and falls to below 40% of its maximum height within less than a quarter of a full alternating cycle.

A still further object of the present invention is to provide an apparatus for carrying out the above process in a cost-effective manner. The invention thus provides an apparatus for the batch ceramic coating of articles made of a valve metal selected from the group consisting of aluminium, zirconium, titanium, hafnium and alloys of these metals, said apparatus comprising: an electrolytic bath comprising water and a solution of an alkali metal hydroxide; an electrode immersed in or containing the electrolyte liquid; another electrode comprising at least one of said articles to be coated and means to suspend said article in said electrolyte; a source of alternate electric current from a high voltage source of at least 700 V; means for shaping the AC wave form; connector elements to complete an electrochemical circuit, and means for adding to said bath, while the apparatus is in operation, a controlled supply of a salt containing a cation of an alkali metal and an oxyacidic anion of an element.

A distinguishing feature of the process of the present invention is its suitability to the production of hard coatings as thick as 300 microns within a reasonable time frame of about 90 minutes. This fast coating rate is achieved by changing the composition of the electrolyte while the coating process is in operation. Coating quality is not compromised by the fast formation of a thick coating, as the modified shaped current achieves momentary melting of the layer near the metal workpiece even after the film has built up to the stated thickness.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

The process of the invention will now be described. The process is used to form a ceramic coating on aluminium, zirconium, titanium, and hafnium. The process is also suited to alloys of these metals, provided the total of all alloying elements does not constitute more than approximately 20% of the whole. Process parameters may be optimized to suit the paticular metal being coated and the particular properties of the coating considered important to a specific application.

The metal workpiece to be coated is connected as the electrode of an electrolytic bath and is immersed therein.

For coating aluminium, electrolytic bath comprising an aqueous solution of an alkali metal hydroxide. In an embodiment of the bath where it is required to optimize the coating to provide maximum adhesion between the metal and its coating, the electrolyte consists essentially of an aqueous solution containing between 0.5 to 2 g/liter of sodium hydroxide or potassium hydroxide. Fine particles of various substances are added if it is required to improve the special, for example, low friction, properties of the coating. Where such particles are added, the electrolyte is agitated to keep the particles in suspension. Similarly, coloured coatings are produced by adding fine particles of pigmenting substances.

The preferred opposite electrode for the process is a stainless steel bath containing the electrolyte liquid. Where it is preferred to hold the electrolyte in a non-conducting container, for example, for safety considerations, the electrode from iron, nickel or stainless steel is inserted into the bath in the conventional manner.

A modified shaped-wave alternate electric current from a high voltage source of at least 700 V, typically 800 V for aluminium workpieces, is then passed between the metal workpiece and the other electrode. This results in dielectric breakdown, heating, melting and thermal compacting of a hydroxide film formed on the surface of the metal to form and weld a ceramic coating thereto. The arc microwelding is visible during coating. A convenient and moderate-cost method of obtaining the required shaped-wave electric pulse current is by use of a capacitor bank connected in series between the high voltage source from 800 to 1,000 V and said metal workpiece which is being coated.

Figure 1:
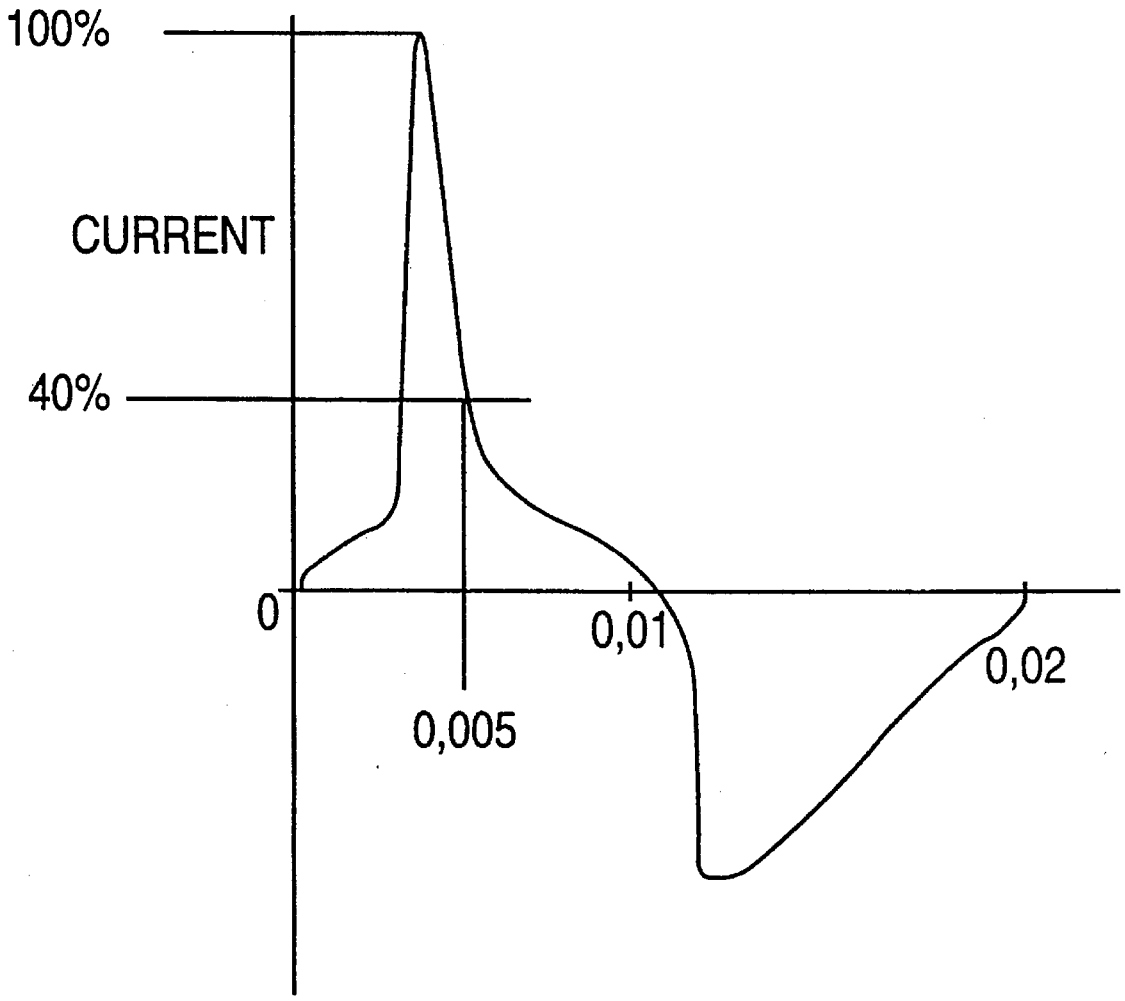
FIG. 1 shows a preferred type of shaped-wave pulse.

Referring now to FIG. 1, there is seen a wave form of preferred shape of current. The effect of using alternating current in combination with a high voltage is to prolong the life of the microarc, which causes intense, local, temporary heating, and as a result, the welding and melting of the coating being formed on the submerged metal workpiece. Anodizing is effected during the first positive half-cycle, the metal workpiece being the positive electrode. Thereafter, the dielectric coating already formed fails dielectrically, thereby starting the generation of microarcs. Arc lifetime extends almost to the end of the first half-cycle. Burning of arc is repeated during the second half-cycle, when the workpiece becomes the negative electrode.

Figure 2:
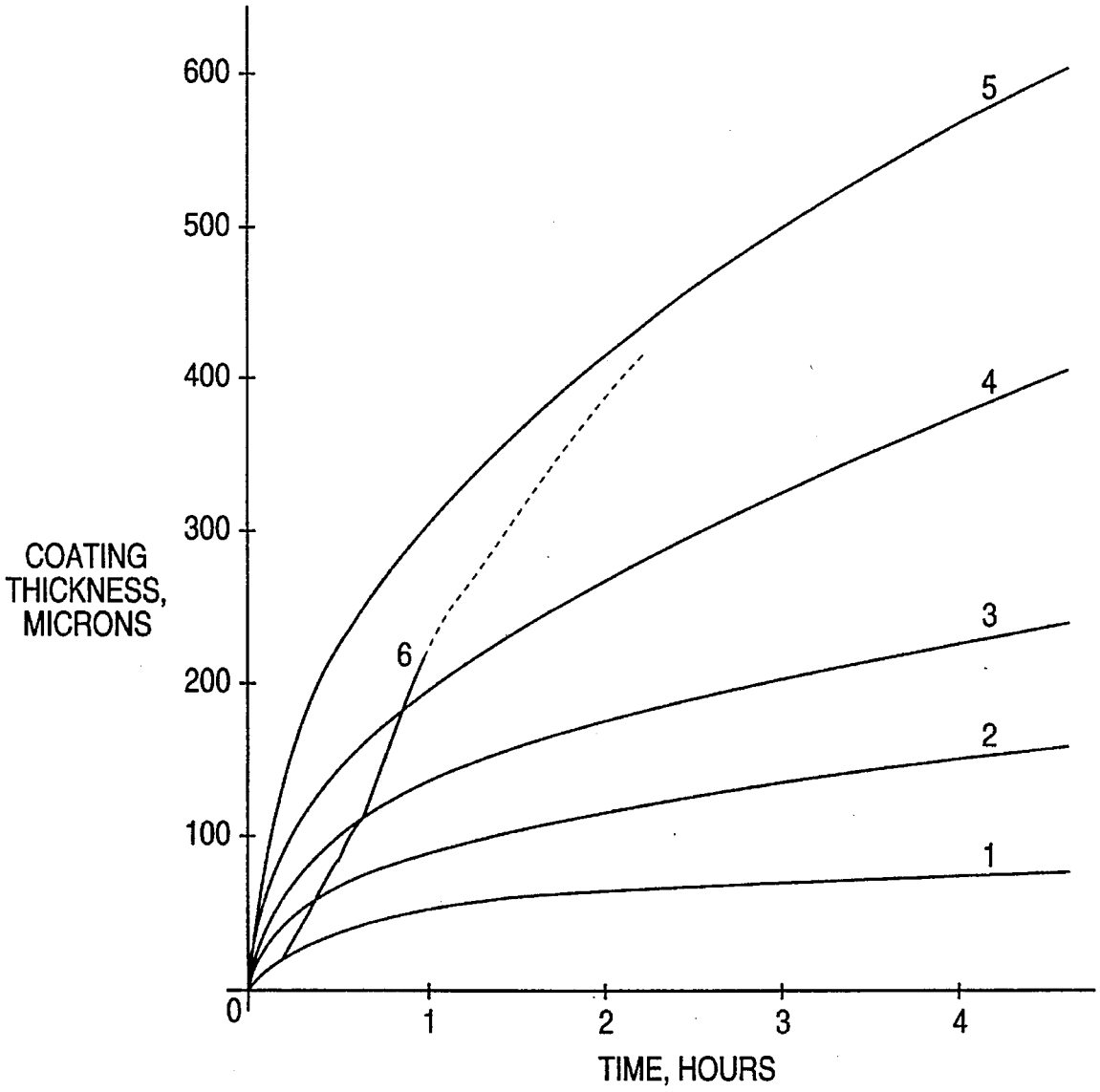
FIG. 2 depicts the relationship between coating thickness and electrolysis time.

Referring now to FIG. 2, there are seen time/coating thickness relationships for processes wherein electrolyte composition is held constant, designated traces 1 to 5. Trace 1 refers to a process wherein the electrolyte is pure potassium hydroxide. Traces 2 to 5 refer to processes wherein increasing concentrations of sodium tetrasilicate were used.

Trace 6 refers to the process of the present invention. It has been found that much faster coating is made possible by changing the composition of the electrolyte while the ceramic coating is being formed. The change effected comprises adding to the electrolyte a salt containing a cation of an alkali metal and an oxyacidic anion of an element. Said element is selected from the group comprising B, Al, Si, Ge, Sn, Pb, As, Sb, Bi, Se, Te, P, Ti, Zr, V, Nb, Ta, Cr, Mo, W, Mn and Fe, said salt being added in a concentration of between 2 and 200 g/liter of solution. A preferred element is silicon, and a preferred added salt is sodium tetrasilicate.

As is seen in the graph, changing of the electrolyte composition during operation allows production of a 200-micron thick coating in approximately 50 minutes, indicating a film formation velocity of 4 microns/minute. Tests have shown that this fast film formation is achieved without sacrificing the quality of film adhesion to the metal workpiece.

Obviously, once the added salt has been mixed into the electrolyte, the only practical way of again reducing salt concentration for coating the next batch of metal articles is to add considerable quantities of new electrolyte liquid. This problem is solved, as shown by the preferred embodiment of the present invention, the details of which are presented hereinafter in Table 2, as well as by utilizing the apparatus to be described further below with reference to FIG. 3.

It has also been found that it is possible to produce a pore-free coating by gradual reduction of the current flow when the film has almost reached its desired thickness. In practice, this is effected by progressively reducing the capacitance used to shape the wave form, thus weakening the current until the process stops.

As will be realized from the above description, the term "modified" as used herein refers to the fact that the wave form is other than the standard sinosidal form normally associated with a wave of alternating current and is instead modified, e.g., as illustrated in FIG. 1, to optimize the coating effect.

Reference is now made to Table 1, which lists various types of coatings for different requirements. Examples are listed of aluminium alloys which have been ceramically coated to achieve various design requirements. Examples 3 and 4 were produced by the technique described above.

TABLE 1

| Example No. | Functional Requirement | Thickness Microns | Hardness (Vickers) kgf/mm² | Porosity Pores/cm² | Notes |
|---|---|---|---|---|---|
| 1 | Undercoat for paint enamel or Teflon coat | 5–30 | 1800–2800 | 50–300 | Intentional high porosity. Strong adherence. |
| 2 | Decorative coating | 10–50 | 1000–2400 | <5 | |
| 3 | Corrosion protection | 30–150 | 1000–2300 | <1 | |
| 4 | Electric insulation | 10–250 | 1000–2300 | <1 | F- |
| 5 | Spacecraft reentry heat shield tiles | 50–300 | 1000–2300 | not applicable | |
| 6 | Wear resistance | 40–100 | 1800–2800 | 5–10 | Undergoes machining before use. |

The aluminium alloy known as "Duralumin" has an alloy designation of 2014 and, because of its strength/weight ratio, has found extensive use in aircraft construction. This alloy was therefore chosen for test coating. Table 2 lists characteristics of an achieved coating and the results obtained.

TABLE 2

| Item | Units | Value |
|---|---|---|
| Metal workpiece material | | Duralumin |
| Wave form production method | | Capacitors |
| Transformer output voltage | V | 800 |
| Current density | A/dm² | |
| Anodic | | 6.0 |
| Cathodic | | 6.3 |
| Electrolyte composition | gram/liter water | |
| First bath: Potassium hydroxide | | 0.5 |
| Second bath: | | |
| Potassium hydroxide | | 0.5 |
| Sodium tetrasilicate | | 4.0 |
| Third bath: | | |
| Potassium hydroxide | | 0.5 |
| Sodium tetrasiucate | | 11.0 |
| Coating time | minutes | |
| in first bath | 10 | |
| in second bath | 10 | |
| in third bath | 20 | |
| Total coating thickness | microns | 100 |
| Average deposition rate | microns/minute | 2.5 |
| Thickness of inner layer fully melted during coating | microns | 65 |
| Substrate adhesion | MPa | 380 |
| Micro Hardness | Vickers kgf/mm² | 2790 |
| Average Composition of layer: | % | |
| Corrundum | | 62 |
| Alumina | | 8 |
| Alumosilicate | | 30 |
| Coating porosity | No. of pores/cm² | 4–6 |
| Pore diameter | microns | 8–11 |

The invention also provides a ceramically-coated metal article produced by the described process. One example of such an article is an aluminium alloy piston for an internal combustion engine. A second example is an aluminium engine block for an internal combustion engine, intended to operate with minimal lubrication. A third example is a protective tile for spacecraft, designed to survive re-entry into the atmosphere. A fourth example is electric insulation serving also as a heat sink of an electronic board.

Figure 3:
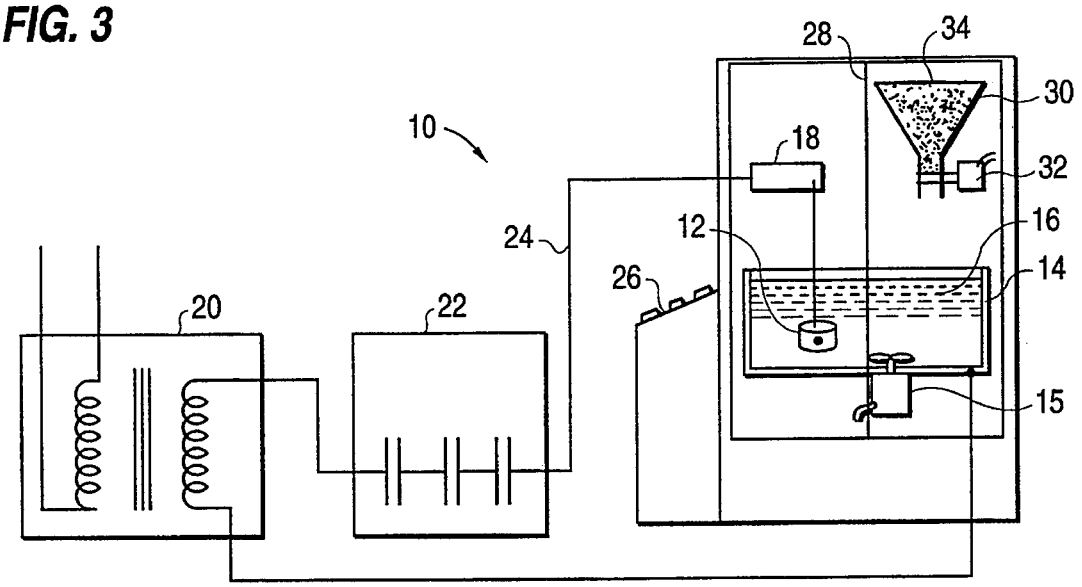
FIG. 3 is a schematic view of an apparatus for batch coating.

FIG. 3 illustrates an apparatus 10 for the batch ceramic coating of articles 12 (first electrode) made of a valve metal selected from the group consisting of aluminium, zirconium, titanium, hafnium and alloys thereof. The apparatus 10 has an electrolytic 40-liter bath 14, comprising an electrolyte liquid 16 of water and a solution of an alkali metal hydroxide. Bath 14 is made of stainless steel and forms the second electrode. Agitation means 15 are provided to stir the electrolyte.

The first electrode comprises at least one of the articles 12 to be coated, and conducting means 18 to suspend said article in the electrolyte liquid 16.

A source of alternate electric current of at least 700 V is a 40,000 V-amp step-up transformer 20, designed to supply up to 800, 900, or 1000 V.

The capacitor bank 22 has a total capacitance of 375 μF and it consists of capacitors with nominal capacitance of 25, 50, 100 and 200 μF. Alternatively, such means could be a rectifier and converter circuit (not shown), or other means of the type shown in Fink and Beaty, *The Standard Handbook for Electrical Engineers,* 12th Ed., pp. 22–96, 22–97.

Connector elements 24 are also provided to complete an electrochemical circuit. An operator control panel 26 is seen at the left of bath 14, the latter being enclosed behind safety doors 28. The opening of safety doors 28 cuts off the electric power.

A salt-containing feed hopper 30, having a solenoid-operated feed valve 32, provides means for adding salt 34 to bath 14 while the apparatus 10 is in operation. Hopper 30 holds a supply of a salt 34, containing a cation of an alkali metal and an oxyacidic anion of an amorphous element. A suitable salt 34 is sodium tetrasilicate.

Figure 4:
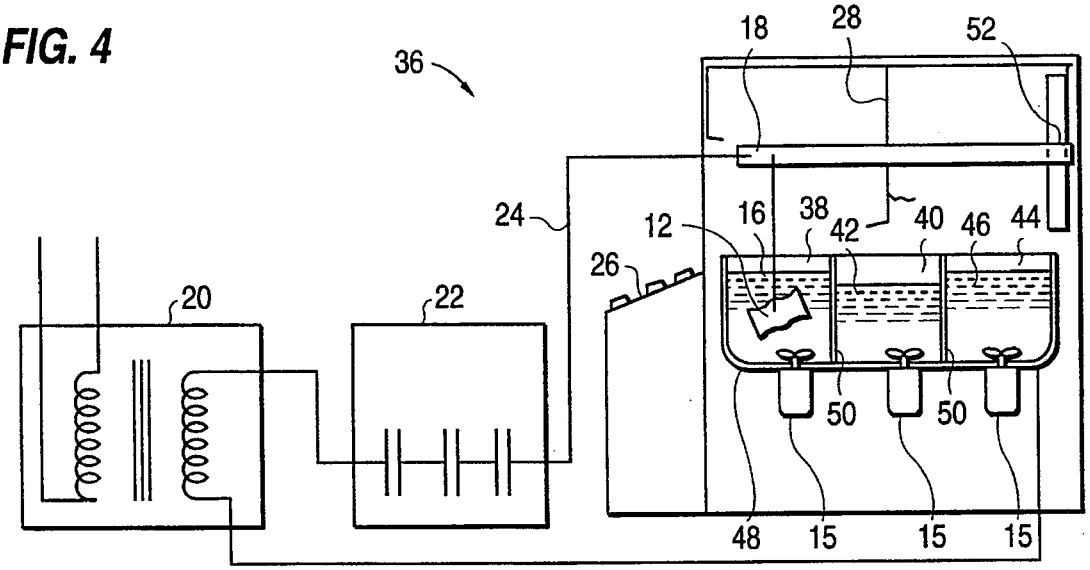
FIG. 4 is a schematic view of an apparatus for series coating.

Shown in FIG. 4 is apparatus 36 for serial ceramic coating of articles 12. A first electrolytic bath 38 contains electrolyte liquid 16, comprising water and a solution of an alkali metal hydroxide. A second electrolytic bath 40 contains an electrolyte liquid 42, comprising water, a solution of an alkali metal hydroxide, and a low concentration of salt 34. A third electrolytic bath 44 contains an electrolyte liquid 46, comprising water, a solution of an alkali metal hydroxide, and a higher salt concentration than in electrolyte 42.

For convenience, baths 38, 40, 44 can comprise a single stainless steel container 48, provided with two vertical dividers 50, forming the electrode. The other electrode comprises at least one of articles 12 to be coated and conducting means 18, which sequentially suspend article 12 in electrolyte liquids 16, 42, 46. Manual or automatic manipulation means 52 allow the transfer of article 12 from the first bath 38 to the second bath 40, and thence to third bath 44.

In apparatus 36, the electrolyte in each bath remains substantially unchanged during operation, and may therefore be used repeatedly. The use of several electrolytes, each having a different composition, enables coating at speeds of about 2.5–4 microns per minute.

The electrical components used are the same as those described hereinabove with reference to FIG. 3.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A process for forming a ceramic coating on a valve metal selected from the group consisting of aluminium, zirconium, titanium, hafnium and alloys of these metals, said process comprising:

(a) immersing said metal as an electrode in an electrolytic bath comprising an aqueous solution of an alkali metal hydroxide;

(b) providing an opposite electrode immersed in or containing the electrolytic bath;

(c) passing a modified shaped-wave alternating electric current from a high voltage source of at least 700 V through a surface of said metal to be coated and said opposite electrode, wherein said modified shaped-wave electric current rises from zero to its maximum height and falls to below 40% of its maximum height within less than a quarter of a full alternating cycle thereby causing dielectric breakdown, heating, melting, and thermal compacting of a hydroxide film formed on the surface of said metal to form and weld a ceramic coating to said metal, and (d) changing the composition of said electrolyte while said ceramic coating is being formed, said change being effected by adding an oxyacid salt of an alkali metal.

2. The process as claimed in claim 1, wherein said modified shaped-wave electric current is obtained by use of a capacitor bank connected in series between said high voltage source and said metal.

3. The process as claimed in claim 1, wherein said added salt is sodium tetrasilicate.

4. The process as claimed in claim 1, wherein said electrolyte consists essentially of an aqueous solution containing between 0.5–2 g/liter of sodium hydroxide.

5. The process as claimed in claim 1, wherein said electrolyte consists essentially of an aqueous solution containing between 0.5–2 grams per liter of potassium hydroxide.

6. The process as claimed in claim 1, wherein said oxyacid salt comprises an element selected from the group comprising B, Al, Si, Ge, Sn, Pb, As, Sb, Bi, Se, Te, P, Ti, Zr, V, Nb, Ta, Cr, Mo, W, Mn and Fe, said salt being added in a concentration of between 2 and 200 grams per liter of solution.

7. The process as claimed in claim 1, wherein fine particles of pigmenting substances are added to produce a colored coating.

8. The process as claimed in claim 1, wherein the current flow is progressively reduced to stop coating.

* * * * *